US009120648B2

(12) United States Patent
Okawa

(10) Patent No.: US 9,120,648 B2
(45) Date of Patent: Sep. 1, 2015

(54) DISK HOISTING TOOL

(75) Inventor: Yoshiaki Okawa, Tokyo (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 0 days.

(21) Appl. No.: 14/007,919

(22) PCT Filed: Aug. 2, 2012

(86) PCT No.: PCT/JP2012/069721

§ 371 (c)(1),
(2), (4) Date: Oct. 22, 2013

(87) PCT Pub. No.: WO2013/031475

PCT Pub. Date: Mar. 7, 2013

(65) Prior Publication Data

US 2014/0327261 A1 Nov. 6, 2014

(30) Foreign Application Priority Data

Aug. 29, 2011 (JP) ..... 2011-185780

(51) Int. Cl.

| | |
|---|---|
| ***B66C 1/66*** | (2006.01) |
| ***F01D 25/28*** | (2006.01) |
| *F01D 5/30* | (2006.01) |
| *F01D 5/32* | (2006.01) |

(52) U.S. Cl.
CPC ..... *B66C 1/66* (2013.01); *F01D 25/285* (2013.01); *F01D 5/3007* (2013.01); *F01D 5/326* (2013.01)

(58) Field of Classification Search
CPC ..... B66C 1/66; B66C 1/663; B66C 1/666; B66C 1/107; F01D 5/3007; F01D 5/326; F01D 25/285
USPC ..... 294/215, 67.1, 67.3, 74, 82.1, 89
See application file for complete search history.

(56) References Cited

U.S. PATENT DOCUMENTS 2,086,318 A * 7/1937 Jackson ..... 414/451
3,091,492 A * 5/1963 Young ..... 294/82.1

(Continued)

FOREIGN PATENT DOCUMENTS

CN 201406273 Y 2/2010
CN 201580895 U 9/2010

(Continued)

OTHER PUBLICATIONS

Office Action dated Jul. 3, 2014, issued in corresponding Chinese Patent Application No. 201280012799.5, with English Translation (8 pages).

(Continued)

*Primary Examiner* — Dean Kramer
(74) *Attorney, Agent, or Firm* — Westerman, Hattori, Daniels & Adrain, LLP

(57) ABSTRACT

Provided is a disk hoisting tool which can prevent deformation or fracture of corner portions of a fitting groove, falling of a disk, and damage to a surface forming the fitting groove, and can safely reverse the disk. The disk hoisting tool which is mounted so as to hoist a disk where a plurality of fitting grooves penetrating in a plate thickness direction are circumferentially formed in a peripheral portion, the disk hoisting tool including a hoisting body (11) that includes: an eye plate (21) having a through hole penetrating in a plate thickness direction; and a fitting projection (22) formed so as to be fitted with the fitting groove.

2 Claims, 14 Drawing Sheets

(56) References Cited

U.S. PATENT DOCUMENTS

| | | | | |
|---|---|---|---|---|
| 4,088,361 | A * | 5/1978 | Ditcher | 294/89 |
| 6,139,253 | A | 10/2000 | Battrel | |
| 6,547,474 | B1 * | 4/2003 | Smetz | 403/78 |
| 2006/0055188 | A1 * | 3/2006 | Koch | 294/1.1 |
| 2009/0095860 | A1 * | 4/2009 | Yoon et al. | 248/225.11 |
| 2010/0078950 | A1 * | 4/2010 | Inda | 294/1.1 |
| 2011/0316297 | A1 * | 12/2011 | Franke | 294/215 |

FOREIGN PATENT DOCUMENTS

| | | | |
|---|---|---|---|
| DE | 295 00 089 | U1 | 5/1996 |
| EP | 0 140 605 | A2 | 5/1985 |
| EP | 0 557 957 | A1 | 9/1993 |
| FR | 2 894 238 | A1 | 6/2007 |
| GB | 1 365 720 | A | 9/1974 |
| JP | 54-136261 | U | 9/1979 |
| JP | 05-238671 | A | 9/1993 |
| JP | 08-029913 | B2 | 3/1996 |
| JP | 3209699 | B2 | 9/2001 |
| JP | 2002-522326 | A | 7/2002 |
| JP | 2003-312979 | A | 11/2003 |
| JP | 2009-126599 | A | 6/2009 |
| JP | 2009-203870 | A | 9/2009 |
| JP | 2011-012346 | A | 1/2011 |
| JP | 2011-46486 | A | 3/2011 |

OTHER PUBLICATIONS

International Search Report for PCT/JP2012/069721, Mailing Date of Oct. 2, 2012.

Written Opinion for PCT/JP2012/069721, Mailing Date of Oct. 2, 2012.

Korean Office Action dated Feb. 25, 2015, issued in corresponding KR Patent Application No. 10-2013-7025273 with English translation (7 pages).

Extended European Search Report dated Mar. 20, 2015, issued in corresponding Application No. 12827471.9 (7 pages).

Decision to Grant a Patent dated Jul. 7, 2015, issued in Japanese application No. 2011-185780. Explanation of relevance: The Decision to Grant a Patent has been received. (3 pages).

* cited by examiner

PRIOR ART

DISK HOISTING TOOL

TECHNICAL FIELD

The present invention relates to a disk hoisting tool for use in hoisting (suspending), for example, a compressor disk that constitutes a compressor (axial flow compressor), or a turbine disk that constitutes a turbine (axial flow turbine), of a gas turbine that supplies fuel to compressed high-temperature and high-pressure air, combusts the air and fuel, and supplies generated combustion gas to a turbine to obtain rotational power.

BACKGROUND ART

In conventional cases, a compressor disk or a turbine disk where a plurality of blade grooves (fitting grooves) penetrating in a plate thickness direction are circumferentially formed (machined) in a peripheral portion (e.g., see FIG. 2 of Patent Literature 1) is hoisted (suspended), for example, by a method as shown in FIG. 28.

CITATION LIST

Patent Literature

{PTL 1}
Japanese Unexamined Patent Application, Publication No. 2011-12346

SUMMARY OF INVENTION

Technical Problem

However, in the method as shown in FIG. 28, that is, a method in which one end portion (end portion (lower end portion) located on a lower side in FIG. 28) of an endless (annular) wire 92 is fitted into (inserted into) a blade groove 91, and a hook 93 of a crane (not shown) is hung on the other end portion (end portion (upper end portion) located on an upper side in FIG. 28) of the wire 92, corner portions of the blade groove 91 indicated by reference numerals 94, 95, 96, and 97 in FIG. 29 may be deformed or fractured.

When the corner portions 94, 95, 96, and 97 are significantly deformed or fractured, the wire 92 may be disengaged from the blade groove 91 (escape from inside the blade groove 91) to cause a disk 98 to fall.

Furthermore, since the wire 92 is in direct contact with a surface forming the blade groove 91, the surface forming the blade groove 91 is disadvantageously damaged by the wire 92.

Although only one wire 92 is shown in FIG. 28 for the simplicity of the drawing, three or four wires 92 are used to hoist a disk at three or four points in actual operations.

The present invention has been made in view of the aforementioned circumstances, and it is an object of the present invention to provide a disk hoisting tool which can prevent deformation or fracture of corner portions of a blade groove, falling of a disk, and damage to a surface forming the blade groove.

Solution to Problem

To achieve the above object, the present invention employs the following solutions.

A disk hoisting tool according to the present invention is a disk hoisting tool which is mounted so as to hoist a disk where a plurality of fitting grooves penetrating in a plate thickness direction are circumferentially formed in a peripheral portion, the disk hoisting tool including a hoisting body that includes: an eye plate having a through hole penetrating in a plate thickness direction; and a fitting projection formed so as to be fitted with the fitting groove.

In accordance with the disk hoisting tool according to the present invention, only the fitting projection formed so as to be fitted with the fitting groove of the disk is inserted into the fitting groove. A wire is not fitted into the fitting groove of the disk unlike in conventional cases.

Accordingly, deformation or fracture of a corner portion of the fitting groove, and damage to a surface forming the fitting groove can be prevented.

Since the deformation or fracture of the corner portion of the fitting groove due to the wire is prevented, falling of the disk can be also prevented. The safety of personnel can be thereby improved.

Moreover, the disk can be safely reversed.

The above disk hoisting tool may further include a fixing means that fixes the hoisting body to the disk.

In the above disk hoisting tool, the fixing means may include: a first stopper that is arranged at one end portion of the fitting projection located on one end surface side of the disk to restrain movement of the hoisting body to the other end surface side of the disk; a first bolt that is inserted into a bolt hole formed in the one end portion of the fitting projection and a bolt hole formed in the first stopper to fix the first stopper to the one end portion of the fitting projection; a second stopper that is arranged at the other end portion of the fitting projection located on the other end surface side of the disk to restrain movement of the hoisting body to the one end surface side of the disk; and a second bolt that is inserted into a bolt hole formed in the other end portion of the fitting projection and a bolt hole formed in the second stopper to fix the second stopper to the other end portion of the fitting projection.

In accordance with the disk hoisting tool, the hoisting body is fixed to the disk via the fixing means. Thus, even when the fitting groove is formed parallel to an axial direction (plate thickness direction) of the disk, the disk can be more safely hoisted. The safety of personnel can be thereby further improved.

In the above disk hoisting tool, it is preferable that the bolt hole is formed such that its axial line is aligned with a longitudinal direction of the fitting projection.

In accordance with the disk hoisting tool, as compared to a case in which the axial line of the bolt hole is formed along a height direction (direction perpendicular to the longitudinal direction) of the fitting projection, decreases in sectional area and strength in the height direction (vertical direction) due to the bolt hole of the fitting projection can be reduced.

Advantageous Effects of Invention

The present invention provides such an effect that deformation or fracture of the corner portion of the blade groove, falling of the disk, and damage to the surface forming the blade groove can be prevented.

DESCRIPTION OF EMBODIMENTS

{First Embodiment}

In the following, a disk hoisting tool according to a first embodiment of the present invention will be described by reference to FIGS. 1 to 12.

Figure 1:
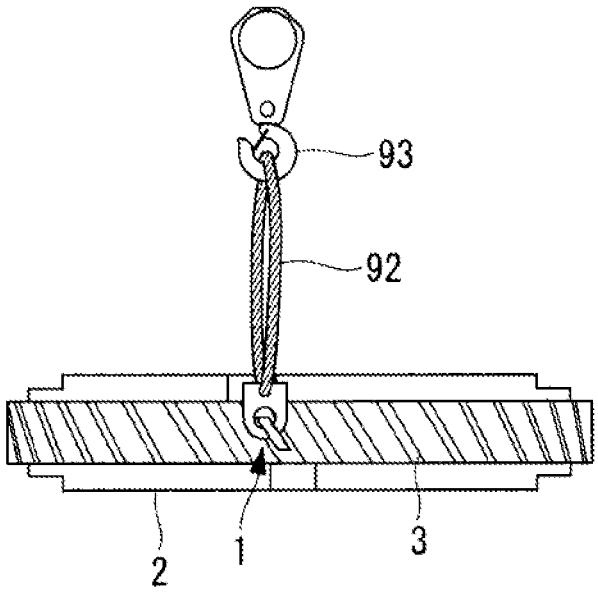
FIG. 1 is a side view illustrating a state in which a compressor disk is hoisted by use of a disk hoisting tool according to a first embodiment of the present invention.
Figure 2:
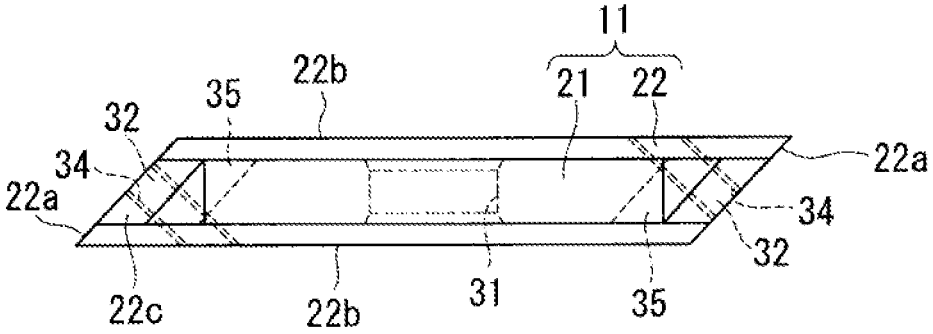
FIG. 2 is a plan view of a hoisting body that constitutes the disk hoisting tool according to the first embodiment of the present invention.
Figure 3:
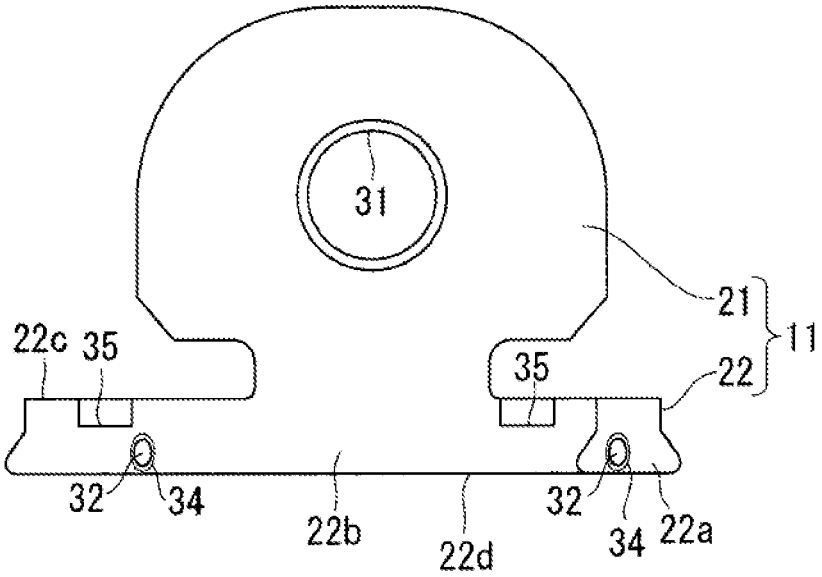
FIG. 3 is a front view (rear view) of the hoisting body that constitutes the disk hoisting tool according to the first embodiment of the present invention.
Figure 4:
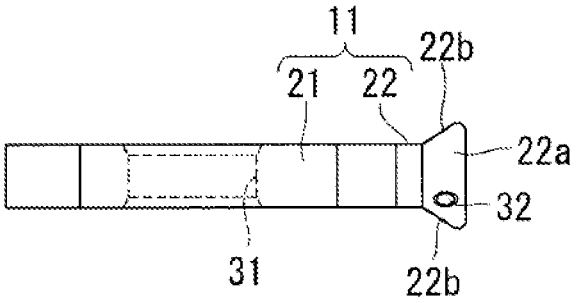
FIG. 4 is a side view of the hoisting body that constitutes the disk hoisting tool according to the first embodiment of the present invention.
Figure 5:
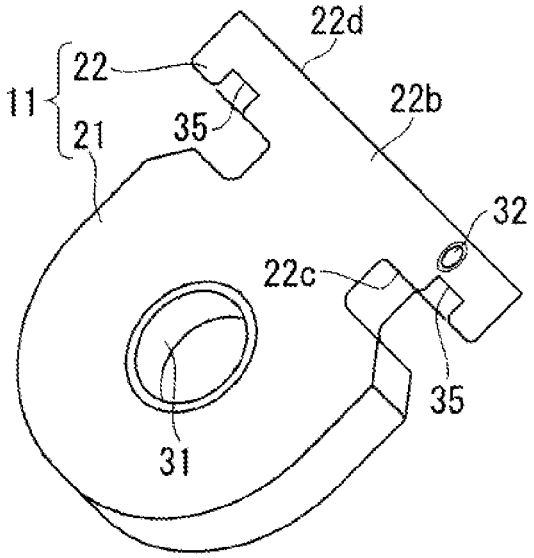
FIG. 5 is a view of the hoisting body shown in FIG. 2 as viewed from a right upper side in FIG. 2 along a shorter side surface forming a fitting projection.
Figure 6:
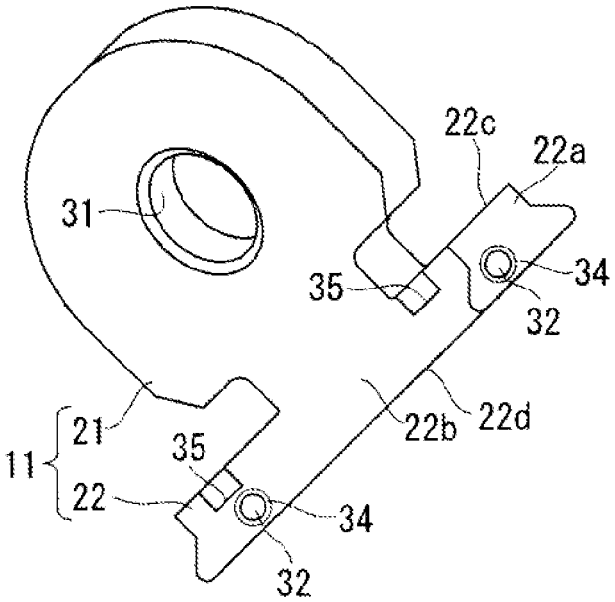
FIG. 6 is a view of the hoisting body shown in FIG. 2 as viewed from a right lower side in FIG. 2 with the shorter side surface forming the fitting projection viewed as a front surface.
Figure 7:
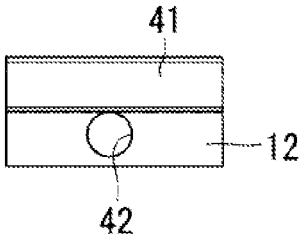
FIG. 7 is a front view (rear view) of a stopper that constitutes the disk hoisting tool according to the first embodiment of the present invention.
Figure 8:
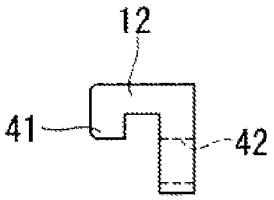
FIG. 8 is a side view of the stopper that constitutes the disk hoisting tool according to the first embodiment of the present invention.
Figure 9:
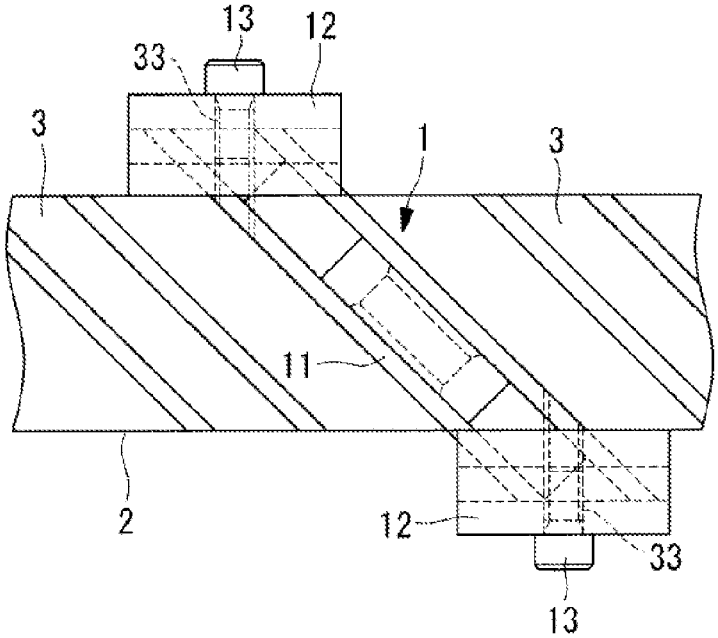
FIG. 9 is a side view of the compressor disk in a state in which the disk hoisting tool according to the first embodiment of the present invention is mounted (attached) to the compressor disk.
Figure 10:
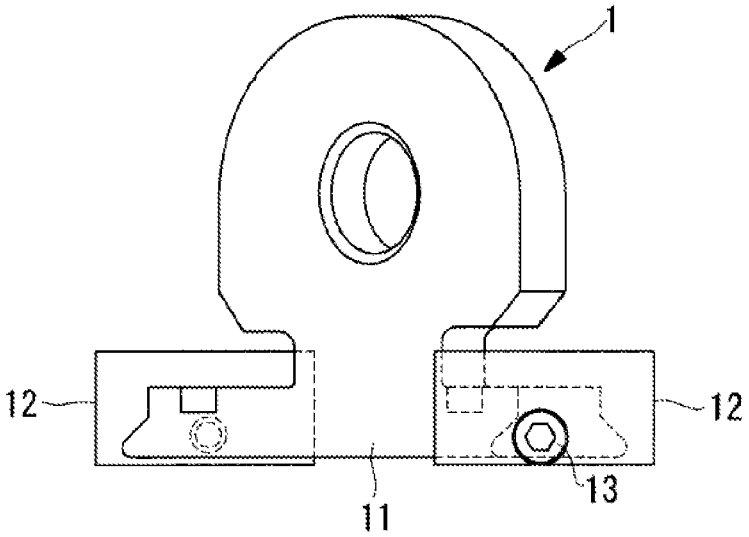
FIG. 10 is a view as viewed from a lower side in FIG. 9 with the stopper shown in FIG. 9 viewed from a front surface.
Figure 11:
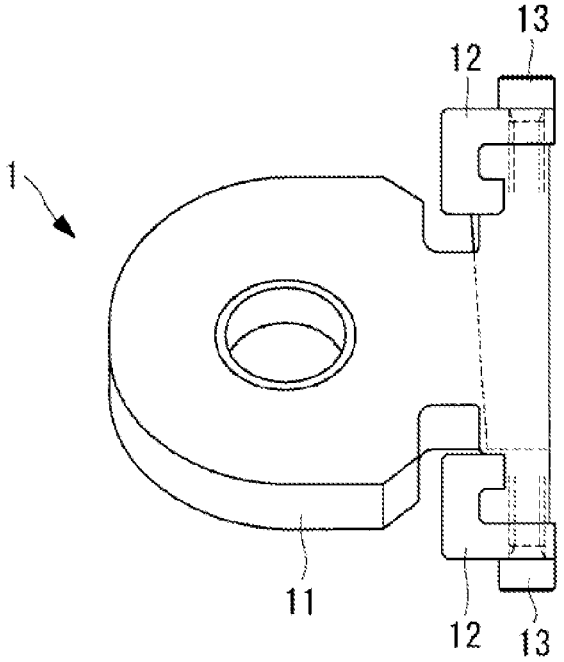
FIG. 11 is a view as viewed from a right side in FIG. 9 with the stopper shown in FIG. 9 viewed from a side surface.
Figure 12:
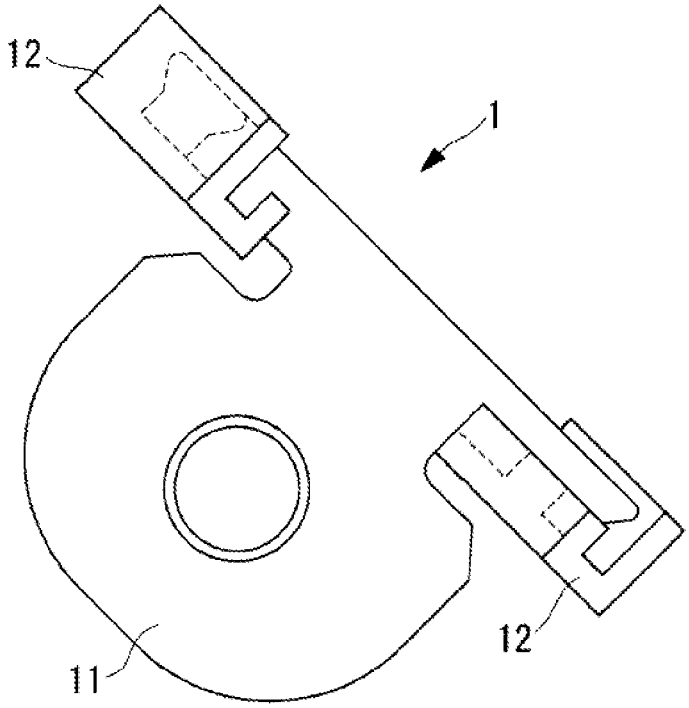
FIG. 12 is a view as viewed from a right upper side in FIG. 9 with the hoisting body shown in FIG. 9 viewed from a front surface.

FIG. 1 is a side view illustrating a state in which a compressor disk is hoisted by use of a disk hoisting tool according to the first embodiment of the present invention. FIG. 2 is a plan view of a hoisting body that constitutes the disk hoisting tool according to the first embodiment of the present invention. FIG. 3 is a front view (rear view) of the hoisting body that constitutes the disk hoisting tool according to the first embodiment of the present invention. FIG. 4 is a side view of the hoisting body that constitutes the disk hoisting tool according to the first embodiment of the present invention. FIG. 5 is a view of the hoisting body shown in FIG. 2 as viewed from a right upper side in FIG. 2 along a shorter side surface forming a fitting projection. FIG. 6 is a view of the hoisting body shown in FIG. 2 as viewed from a right lower side in FIG. 2 with the shorter side surface forming the fitting projection viewed as a front surface. FIG. 7 is a front view (rear view) of a stopper that constitutes the disk hoisting tool according to the first embodiment of the present invention. FIG. 8 is a side view of the stopper that constitutes the disk hoisting tool according to the first embodiment of the present invention. FIG. 9 is a side view of the compressor disk in a state in which the disk hoisting tool according to the first embodiment of the present invention is mounted (attached) to the compressor disk. FIG. 10 is a view as viewed from a lower side in FIG. 9 with the stopper shown in FIG. 9 viewed from a front surface. FIG. 11 is a view as viewed from a right side in FIG. 9 with the stopper shown in FIG. 9 viewed from a side surface. FIG. 12 is a view as viewed from a right upper side in FIG. 9 with the hoisting body shown in FIG. 9 viewed from a front surface.

A disk hoisting tool 1 according to the present embodiment is used for hoisting (suspending) a compressor disk 2 that constitutes a compressor (axial flow compressor) of a gas turbine. The disk hoisting tool 1 is fixed (mounted) to the compressor disk 2 as shown in FIG. 1.

Figure 28:
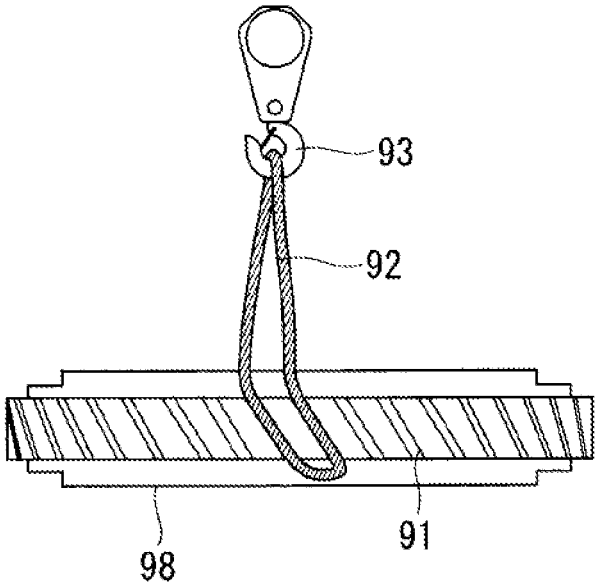
FIG. 28 is a side view illustrating a state in which a compressor disk is hoisted in a conventional method.
Figure 29:
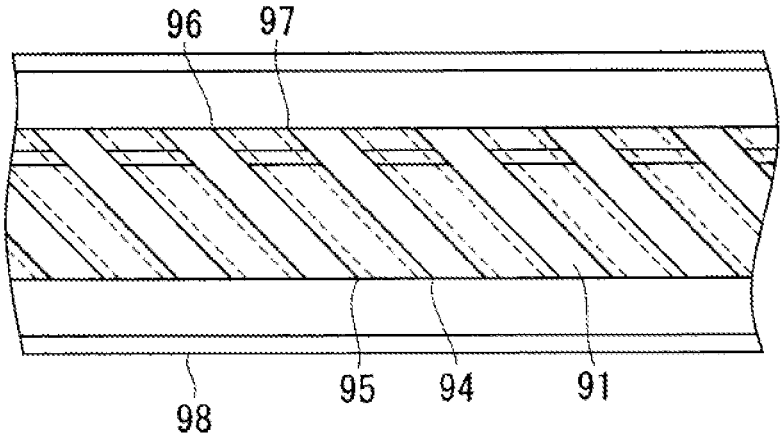
PRIOR ART FIG. 29
FIG. 29 is a side view for explaining a conventional problem.

Reference numerals 92 and 93 in FIG. 1 respectively denote a wire, and a hook of a crane (not shown) described using FIG. 28.

Although only one wire 92 is shown in FIG. 1 for the simplicity of the drawing, three or four wires 92, and three or four sets of disk hoisting tools 1 are used to hoist a disk at three or four points in actual operations.

The compressor disk 2 has a disk-like shape. A plurality of blade grooves (fitting grooves) 3 penetrating in a plate thickness direction are circumferentially formed (machined) in a peripheral portion of the compressor disk 2.

As shown in FIGS. 9 to 12, one set of disk hoisting tool 1 includes one hoisting (tool) body 11, two stoppers 12, and two hexagon socket head bolts 13.

As shown in FIGS. 2 to 6, the hoisting body 11 includes an eye plate 21, and a fitting projection 22.

As shown in FIG. 3, the eye plate 21 is a plate-like member in which an eye (through hole) 31 assuming a circular shape when viewed from a front surface (rear surface) of the eye plate 21 and penetrating in a plate thickness direction is formed in its center portion. The eye plate 21 is formed integrally with (continuously from) the fitting projection 22.

As shown in FIG. 2, the fitting projection 22 is a member whose outline assumes a parallelogram shape when viewed from an upper surface 22*c* of the fitting projection 22 and that is formed so as to be fitted with (fitted into) the blade groove 3 (that is, a member having the same shape as a blade root (base) of a blade (not shown) to be embedded in the blade groove 3). The fitting projection 22 is formed integrally with (continuously from) the eye plate 21. A bolt hole 32 whose axial line (center line) is perpendicular to a shorter side surface 22*a* forming the fitting projection 22, and that penetrates (extends) to a longer side surface 22*b* forming the fitting projection 22 is formed in the side surface 22*a*. A female threaded portion 34 to be screwed with a male threaded portion 33 (see FIG. 9) that is formed on an outer peripheral surface of each of the hexagon socket head bolts 13 is formed on an inner peripheral surface of the bolt hole 32. A linear groove 35 that is formed downward from the upper surface 22*c* toward a lower surface 22*d* such that a claw portion 41 of each of the stoppers 12 is fitted therein (engaged therewith) is also formed in an upper half portion at each of both side portions of the fitting projection 22 so as to be parallel to the shorter side surface 22*a* forming the fitting projection 22.

Each of the stoppers 12 is a plate-like member assuming a rectangular shape when viewed from a front surface (rear surface) of the stopper 12 as shown in FIG. 7, and assuming an L shape when viewed from a side surface of the stopper 12 as shown in FIG. 8. The claw portion (projection) 41 having a rectangular parallelepiped shape is formed integrally with (continuously from) a distal end portion of each of the stoppers 12. As shown in FIG. 7, a bolt hole (through hole) 42 penetrating in a plate thickness direction is also formed in a center portion of a plate-like member forming a proximal end portion of each of the stoppers 12 when viewed from the front surface (rear surface) of the stopper 12. A female threaded portion to be screwed with the male threaded portion 33 (see FIG. 9) formed on the outer peripheral surface of each of the hexagon socket head bolts 13 is not formed on an inner peripheral surface of the bolt hole 42.

Next, a procedure to mount the disk hoisting tool 1 according to the present embodiment to the compressor disk 2 will be described.

First, the eye plate 21 is gripped, and the fitting projection 22 is inserted into the blade groove 3 from one end surface side (end surface (upper end surface) located on an upper side in FIGS. 2 and 9) or the other end surface side (end surface (lower end surface) located on a lower side in FIGS. 2 and 9) of the compressor disk 2.

The fitting projection 22 is inserted into the blade groove 3 until both end portions of the fitting projection 22 equally project from the one and the other end surfaces of the compressor disk 2.

Subsequently, the claw portion 41 provided on one of the stoppers 12 is inserted into the groove 35 provided in one end portion of the fitting projection 22. One of the hexagon socket head bolts 13 is screwed into the bolt hole 42 provided in the stopper 12 and the bolt hole 32 provided in the one end portion of the fitting projection 22. The one stopper 12 and the one hexagon socket head bolt 13 are thereby fixed to the one end portion of the fitting projection 22.

The claw portion 41 provided on the other of the stoppers 12 is then inserted into the groove 35 provided in the other end portion of the fitting projection 22. The other of the hexagon socket head bolts 13 is screwed into the bolt hole 42 provided in the stopper 12 and the bolt hole 32 provided in the other end portion of the fitting projection 22. The other stopper 12 and the other hexagon socket head bolt 13 are thereby fixed to the other end portion of the fitting projection 22. The operation of mounting one set of disk hoisting tool 1 to the compressor disk 2 is completed.

When the compressor disk 2 is hoisted at three or four points, three or four sets of disk hoisting tools 1 are mounted to predetermined positions of the compressor disk 2 in the same procedure.

A procedure to remove the disk hoisting tool 1 according to the present embodiment from the compressor disk 2 is simply opposite to the above procedure. Thus, the description thereof is omitted here.

In accordance with the disk hoisting tool 1 according to the present embodiment, only the fitting projection 22 formed so as to be fitted with the blade groove 3 of the compressor disk 2 is inserted into the blade groove 3. The wire 92 is not fitted into the blade groove 3 of the compressor disk 2 unlike in conventional cases.

Accordingly, deformation or fracture of a corner portion of the blade groove 3. and damage to a surface forming the blade groove 3 can be prevented.

Since the deformation or fracture of the corner portion of the blade groove 3 due to the wire 92 is prevented, filling of the compressor disk 2 can be also prevented. The safety of personnel can be thereby improved.

Moreover, the compressor disk 2 can be safely reversed.

In accordance with the disk hoisting tool 1 according to the present embodiment, the hoisting body 11 is fixed to the compressor disk 2 via a fixing means including the two stoppers (a first stopper and a second stopper) 12, and the two hexagon socket head bolts (a first bolt and a second bolt) 13. Thus, even when the blade groove 3 is formed parallel to an axial direction (plate thickness direction) of the compressor disk 2, the compressor disk 2 can be more safely hoisted. The safety of personnel can be further improved.

Furthermore, in accordance with the disk hoisting tool 1 according to the present embodiment, as compared to a case in which the axial line of the bolt hole 32 is formed along a height direction (direction perpendicular to a longitudinal direction) of the fitting projection 22 (e.g., a case described in a second embodiment described below), decreases in sectional area and strength in the height direction (vertical direction) due to the bolt hole 32 of the fitting projection 22 can be reduced.

{Second Embodiment}

A disk hoisting tool according to a second embodiment of the present invention will be described by reference to FIGS. 13 to 21.

Figure 13:
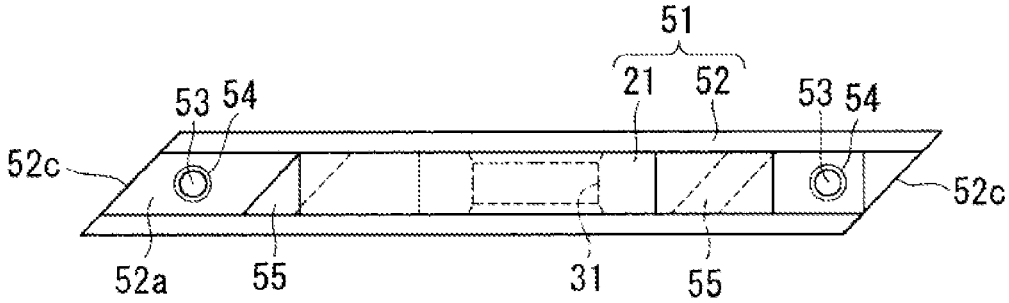
FIG. 13 is a plan view of a hoisting body that constitutes a disk hoisting tool according to a second embodiment of the present invention.
Figure 14:
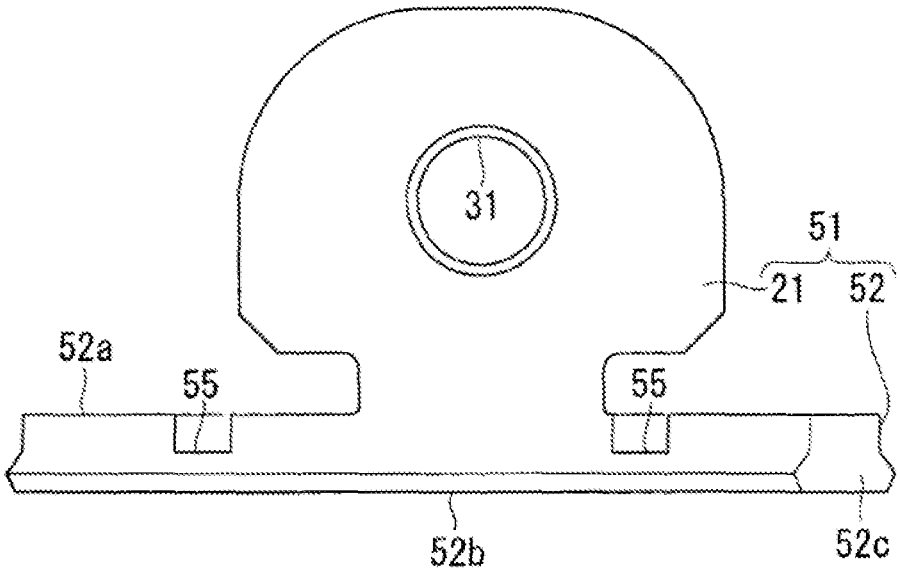
FIG. 14 is a front view (rear view) of the hoisting body that constitutes the disk hoisting tool according to the second embodiment of the present invention.
Figure 15:
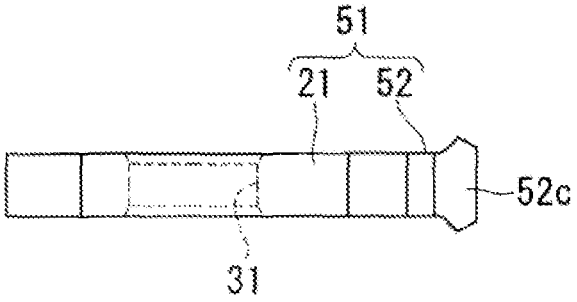
FIG. 15 is a side view of the hoisting body that constitutes the disk hoisting tool according to the second embodiment of the present invention.
Figure 16:
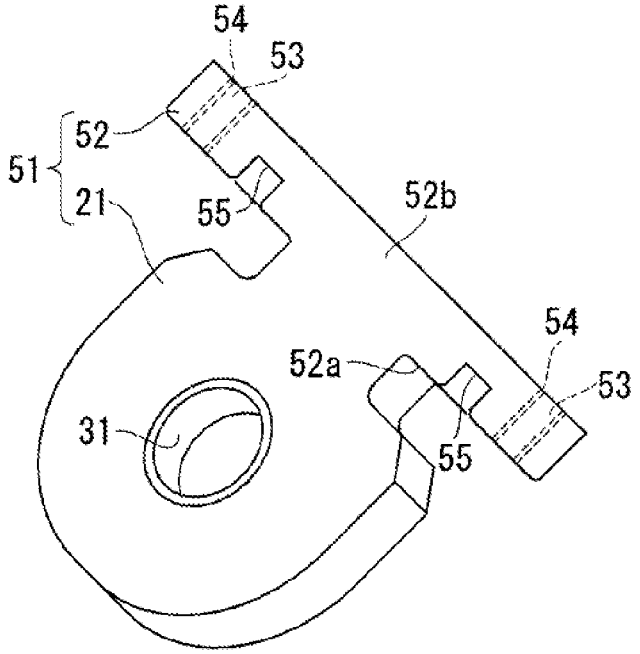
FIG. 16 is a view of the hoisting body shown in FIG. 13 as viewed from a right upper side in FIG. 13 along a shorter side surface forming a fitting projection.
Figure 17:
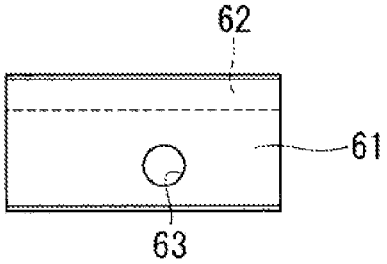
FIG. 17 is a front view (rear view) of a stopper that constitutes the disk hoisting tool according to the second embodiment of the present invention.
Figure 18:
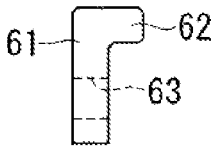
FIG. 18 is a side view of the stopper that constitutes the disk hoisting tool according to the second embodiment of the present invention.
Figure 19:
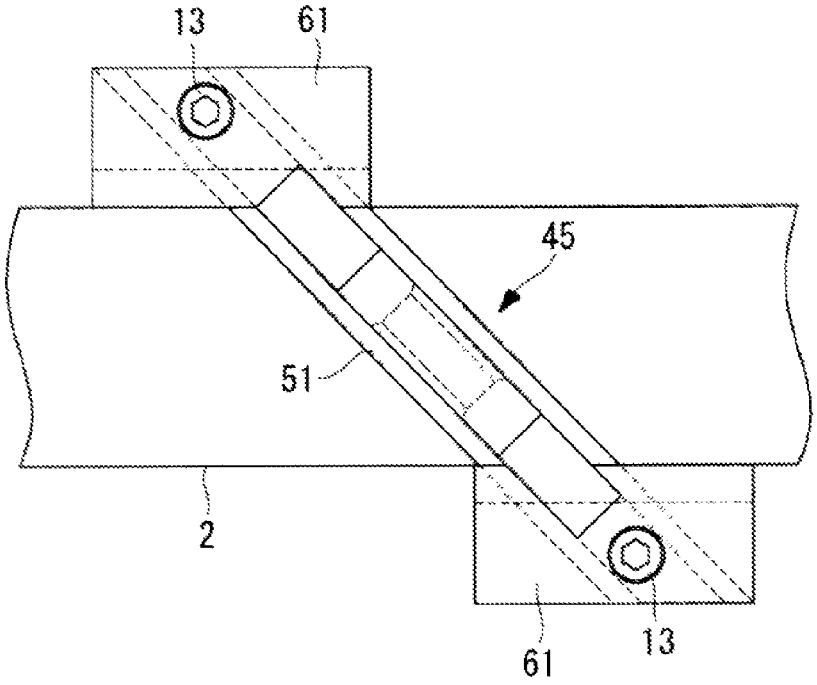
FIG. 19 is a side view of a compressor disk in a state in which the disk hoisting tool according to the second embodiment of the present invention is mounted (attached) to the compressor disk.
Figure 20:
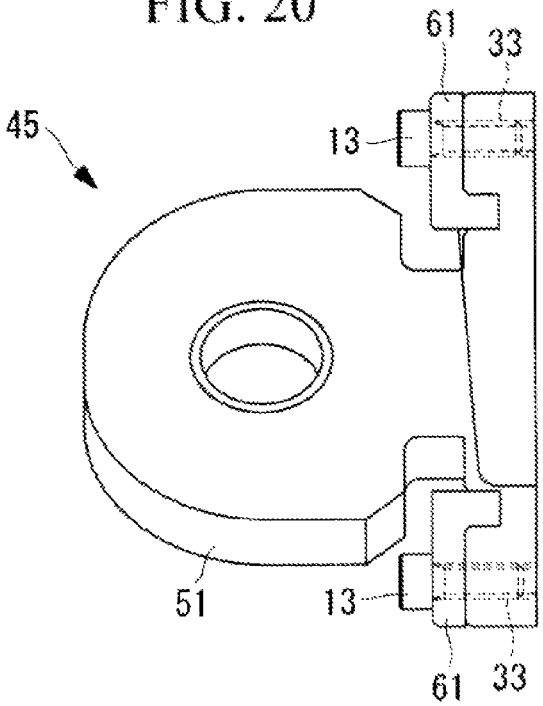
FIG. 20 is a view as viewed from a right side in FIG. 19 with the stopper shown in FIG. 19 viewed from a side surface.
Figure 21:
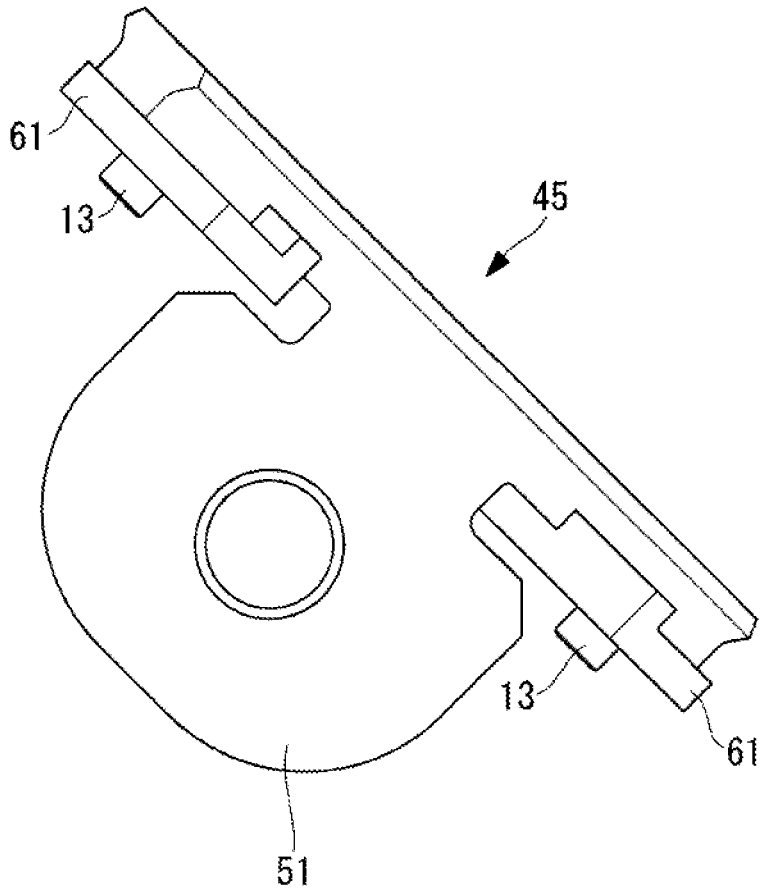
FIG. 21 is a view as viewed from a right upper side in FIG. 19 with the hoisting body shown in FIG. 19 viewed from a front surface.

FIG. 13 is a plan view of a hoisting body that constitutes a disk hoisting tool according to the second embodiment of the present invention. FIG. 14 is a front view (rear view) of the hoisting body that constitutes the disk hoisting tool according to the second embodiment of the present invention. FIG. 15 is a side view of the hoisting body that constitutes the disk hoisting tool according to the second embodiment of the present invention. FIG. 16 is a view of the hoisting body shown in FIG. 13 as viewed from a right upper side in FIG. 13 along a shorter side surface forming a fitting projection. FIG. 17 is a front view (rear view) of a stopper that constitutes the disk hoisting tool according to the second embodiment of the present invention. FIG. 18 is a side view of the stopper that constitutes the disk hoisting tool according to the second embodiment of the present invention. FIG. 19 is a side view of a compressor disk in a state in which the disk hoisting tool according to the second embodiment of the present invention is mounted (attached) to the compressor disk. FIG. 20 is a view as viewed from a right side in FIG. 19 with the stopper shown in FIG. 19 viewed from a side surface. FIG. 21 is a view as viewed from a right upper side in FIG. 19 with the hoisting body shown in FIG. 19 viewed from a front surface.

A disk hoisting tool 45 according to the present embodiment is used for hoisting (suspending) a compressor disk 2 that constitutes a compressor (axial flow compressor) of a gas turbine. The disk hoisting tool 45 is fixed (mounted) to the compressor disk 2 in a similar manner to the aforementioned first embodiment.

As shown in FIGS. 19 to 21, one set of disk hoisting tool 45 includes one hoisting (tool) body 51, two stoppers 61, and two hexagon socket head bolts 13.

As shown in FIGS. 13 to 16, the hoisting body 51 includes an eye plate 21, and a fitting projection 52.

As shown in FIG. 14, the eye plate 21 is a plate-like member in which an eye (through hole) 31 assuming a circular shape when viewed from a front surface (rear surface) of the eye plate 21 and penetrating in a plate thickness direction is formed in its center portion. The eye plate 21 is formed integrally with (continuously from) the fitting projection 52.

As shown in FIG. 13, the fitting projection 52 is a member whose outline assumes a parallelogram shape when viewed from an upper surface 52*a* of the fitting projection 52 and that is formed so as to be fitted with (fitted into) the blade groove 3 (that is, a member having the same shape as a blade root (base) of a blade (not shown) to be embedded in the blade groove 3). The fitting projection 52 is formed integrally with (continuously from) the eye plate 21. A bolt hole 53 whose axial line (center line) is perpendicular to the upper surface 52*a* forming the fitting projection 52, and that penetrates (extends) to a lower surface 52*b* forming the fitting projection 52 is formed in the upper surface 52*a*. A female threaded portion 54 to be screwed with a male threaded portion 33 (see FIG. 20) that is formed on an outer peripheral surface of each of the hexagon socket head bolts 13 is formed on an inner peripheral surface of the bolt hole 53. A linear groove 55 that is formed downward from the upper surface 52*a* toward the lower surface 52*b* such that a claw portion 62 of each of the stoppers 61 is fitted therein (engaged therewith) is also formed in an upper half portion at each of both side portions of the fitting projection 52 so as to be parallel to a shorter side surface 52*c* forming the fitting projection 52.

Each of the stoppers 61 is a plate-like member assuming a rectangular shape when viewed from a front surface (rear surface) of the stopper 61 as shown in FIG. 17, and assuming an L shape when viewed from a side surface of the stopper 61 as shown in FIG. 18. The claw portion (projection) 62 having a rectangular parallelepiped shape is formed integrally with (continuously from) a distal end portion of each of the stoppers 61. As shown in FIG. 17, a bolt hole (through hole) 63 penetrating in a plate thickness direction is also formed in a center portion of a plate-like member forming a proximal end portion of each of the stoppers 61 when viewed from the front surface (rear surface) of the stopper 61. A female threaded portion to be screwed with the male threaded portion 33 (see FIG. 20) formed on the outer peripheral surface of each of the hexagon socket head bolts 13 is not formed on an inner peripheral surface of the bolt hole 63.

Next, a procedure to mount the disk hoisting tool 45 according to the present embodiment to the compressor disk 2 will be described.

First, the eye plate 21 is gripped, and the fitting projection 52 is inserted into the blade groove 3 from one end surface side (end surface (upper end surface) located on an upper side in FIG. 19) or the other end surface side (end surface (lower end surface) located on a lower side in FIG. 19) of the compressor disk 2.

The fitting projection 52 is inserted into the blade groove 3 until both end portions of the fitting projection 52 equally project from the one and the other end surfaces of the compressor disk 2.

Subsequently, the claw portion 62 provided on one of the stoppers 61 is inserted into the groove 55 provided in one end portion of the fitting projection 52. One of the hexagon socket head bolts 13 is screwed into the bolt hole 63 provided in the stopper 61 and the bolt hole 53 provided in the one end portion of the fitting projection 52. The one stopper 61 and the one hexagon socket head bolt 13 are thereby fixed to the one end portion of the fitting projection 52.

The claw portion 62 provided on the other of the stoppers 61 is then inserted into the groove 55 provided in the other end portion of the fitting projection 52. The other of the hexagon socket head bolts 13 is screwed into the bolt hole 63 provided in the stopper 61 and the bolt hole 53 provided in the other end portion of the fitting projection 52. The other stopper 61 and the other hexagon socket head bolt 13 are thereby fixed to the other end portion of the fitting projection 52. The operation of mounting one set of disk hoisting tool 45 to the compressor disk 2 is completed.

When the compressor disk 2 is hoisted at three or four points, three or four sets of disk hoisting tools 45 are mounted to predetermined positions of the compressor disk 2 in the same procedure.

A procedure to remove the disk hoisting tool 45 according to the present embodiment from the compressor disk 2 is simply opposite to the above procedure. Thus, the description thereof is omitted here.

In accordance with the disk hoisting tool 45 according to the present embodiment, only the fitting projection 52 formed so as to be fitted with the blade groove 3 of the compressor disk 2 is inserted into the blade groove 3. The wire 92 is not fitted into the blade groove 3 of the compressor disk 2 unlike in conventional cases.

Accordingly, deformation or fracture of a corner portion of the blade groove 3, and damage to a surface forming the blade groove 3 can be prevented.

Since the deformation or fracture of the corner portion of the blade groove 3 due to the wire 92 is prevented, falling of the compressor disk 2 can be also prevented. The safety of personnel can be thereby improved.

Moreover, the compressor disk 2 can be safely reversed.

In accordance with the disk hoisting tool 45 according to the present embodiment, the hoisting body 51 is fixed to the compressor disk 2 via a fixing means including the two stoppers (a first stopper and a second stopper) 61, and the two hexagon socket head bolts (a first bolt and a second bolt) 13. Thus, even when the blade groove 3 is formed parallel to an axial direction (plate thickness direction) of the compressor disk 2, the compressor disk 2 can be more safely hoisted. The safety of personnel can be further improved.

{Third Embodiment}

A disk hoisting tool according to a third embodiment of the present invention will be described by reference to FIGS. 22 to 27.

Figure 22:
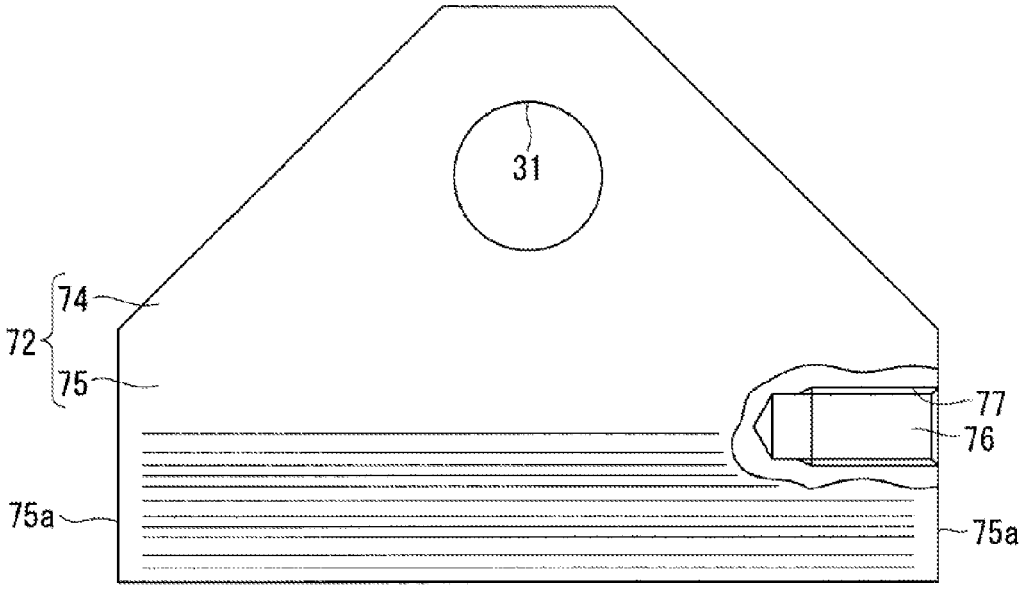
FIG. 22 is a front view (rear view) of a hoisting body that constitutes a disk hoisting tool according to a third embodiment of the present invention.
Figure 23:
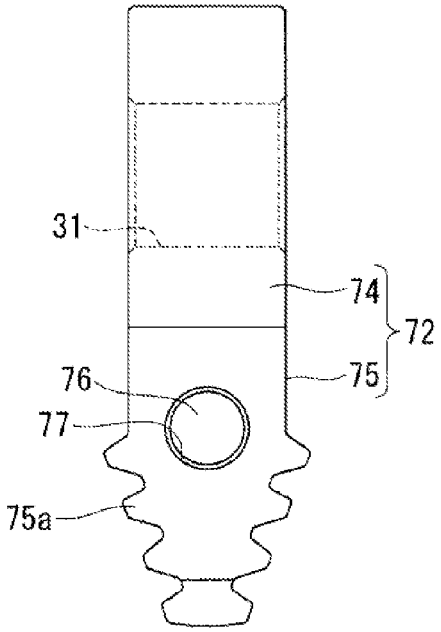
FIG. 23 is a side view of the hoisting body that constitutes the disk hoisting tool according to the third embodiment of the present invention.
Figure 24:
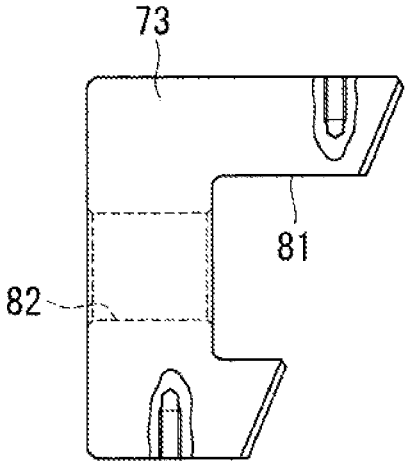
FIG. 24 is a side view of a stopper that constitutes the disk hoisting tool according to the third embodiment of the present invention.
Figure 25:
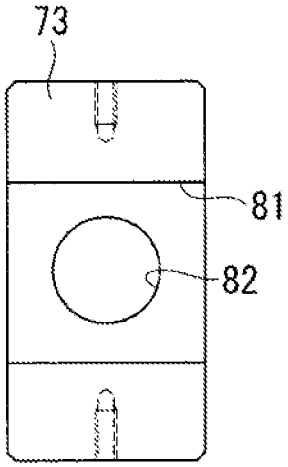
FIG. 25 is a front view (rear view) of the stopper that constitutes the disk hoisting tool according to the third embodiment of the present invention.
Figure 26:
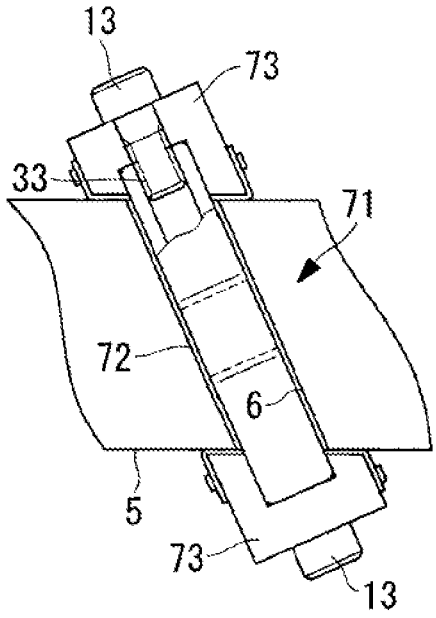
FIG. 26 is a side view of a turbine disk in a state in which the disk hoisting tool according to the third embodiment of the present invention is mounted (attached) to the turbine disk.
Figure 27:
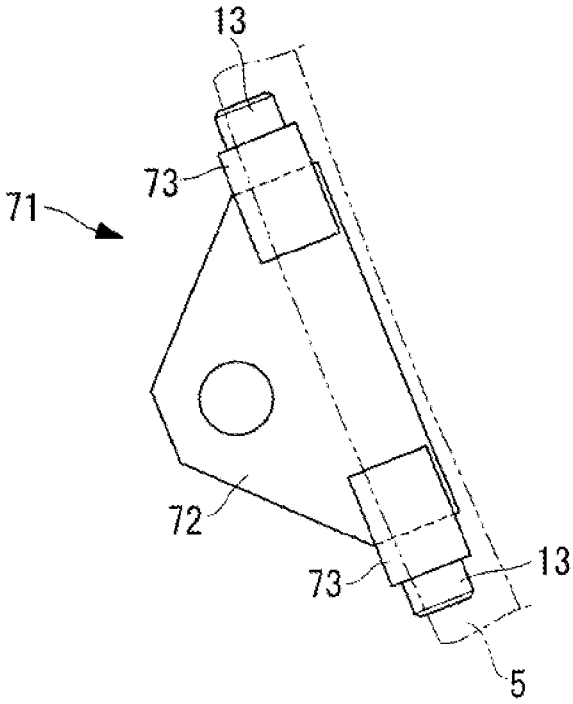
FIG. 27 is a view as viewed from a right upper side in FIG. 26 with the hoisting body shown in FIG. 26 viewed from a front surface.

FIG. 22 is a front view (rear view) of a hoisting body that constitutes a disk hoisting tool according to the third embodiment of the present invention. FIG. 23 is a side view of the hoisting body that constitutes the disk hoisting tool according to the third embodiment of the present invention. FIG. 24 is a side view of a stopper that constitutes the disk hoisting tool according to the third embodiment of the present invention. FIG. 25 is a front view (rear view) of the stopper that constitutes the disk hoisting tool according to the third embodiment of the present invention. FIG. 26 is a side view of a turbine disk in a state in which the disk hoisting tool according to the third embodiment of the present invention is mounted (attached) to the turbine disk. FIG. 27 is a view as viewed from a right upper side in FIG. 26 with the hoisting body shown in FIG. 26 viewed from a front surface.

A disk hoisting tool 71 according to the present embodiment is used for hoisting (suspending) a turbine disk 5 (see FIG. 26) that constitutes a turbine (axial flow turbine) of a gas turbine. The disk hoisting tool 71 is fixed (mounted) to the turbine disk 5 in a similar manner to the aforementioned embodiments.

The turbine disk 5 has a disk-like shape. A plurality of blade grooves (fitting grooves) 6 (see FIG. 26) penetrating in a plate thickness direction are circumferentially formed (machined) in a peripheral portion of the turbine disk 5.

As shown in FIGS. 26 and 27, one set of disk hoisting tool 71 includes one hoisting (tool) body 72, two stoppers 73, and two hexagon socket head bolts 13.

As shown in FIGS. 22 and 23, the hoisting body 72 includes an eye plate 74, and a fitting projection 75.

As shown in FIG. 22, the eye plate 74 is a plate-like member in which an eye (through hole) 31 assuming a circular shape when viewed from a front surface (rear surface) of the eye plate 74 and penetrating in a plate thickness direction is formed in its center portion. The eye plate 74 is formed integrally with (continuously from) the fitting projection 75.

As shown in FIG. 26, the fitting projection 75 is a member whose outline assumes a rectangular shape when viewed from an upper side of the fitting projection 75 and that is formed so as to be fitted with (fitted into) the blade groove 6 (that is, a member having the same shape as a blade root (base) of a blade (not shown) to be embedded in the blade groove 6). The fitting projection 75 is formed integrally with (continuously from) the eye plate 74. A bolt hole 76 whose axial line (center line) is perpendicular to a shorter side surface 75*a* forming the fitting projection 75, and that is pierced toward the other side surface 75*a* (opposite thereto) is formed in the side surface 75*a*. A female threaded portion 77 to be screwed with a male threaded portion 33 (see FIG. 26) that is formed on an outer peripheral surface of each of the hexagon socket head bolts 13 is formed on an inner peripheral surface of the bolt hole 76.

Each of the stoppers 73 is a plate-like member assuming a rectangular shape when viewed from a front surface (rear surface) of the stopper 73 as shown in FIG. 25, and assuming a square-U shape when viewed from a side surface of the stopper 73 as shown in FIG. 24. A concave portion 81 that receives (accommodates) an end portion (one end portion or the other end portion) of the fitting projection 75 is formed in a heightwise center portion of each of the stoppers 73 continuously over an entire direction (width direction) perpendicular to the height direction. As shown in FIG. 25, a bolt hole (through hole) 82 penetrating in a plate thickness direction to bring into communication a side surface 73*a* and the concave portion 81 of each of the stoppers 73 is also formed in a heightwise and widthwise center portion of the stopper 73 when viewed from the front surface (rear surface) of the stopper 73. A female threaded portion to be screwed with the male threaded portion 33 (see FIG. 26) formed on the outer peripheral surface of each of the hexagon socket head bolts 13 is not formed on an inner peripheral surface of the bolt hole 82.

Next, a procedure to mount the disk hoisting tool 71 according to the present embodiment to the turbine disk 5 will be described.

First, the eye plate 74 is gripped, and the fitting projection 75 is inserted into the blade groove 6 from one end surface side (end surface (upper end surface) located on an upper side in FIG. 26) or the other end surface side (end surface (lower end surface) located on a lower side in FIG. 26) of the turbine disk 5.

The fitting projection 75 is inserted into the blade groove 6 until both end portions of the fitting projection 75 equally project from the one and the other end surfaces of the turbine disk 5.

Subsequently, one end portion of the fitting projection 75 is inserted into the concave portion 81 provided in one of the stoppers 73. One of the hexagon socket head bolts 13 is screwed into the bolt hole 82 provided in the stopper 73 and the bolt hole 76 provided in the one end portion of the fitting projection 75. The one stopper 73 and the one hexagon socket head bolt 13 are thereby fixed to the one end portion of the fitting projection 75.

The other end portion of the fitting projection 75 is then inserted into the concave portion 81 provided in the other of the stoppers 73. The other of the hexagon socket head bolts 13 is screwed into the bolt hole 82 provided in the stopper 73 and the bolt hole 76 provided in the other end portion of the fitting projection 75. The other stopper 73 and the other hexagon socket head bolt 13 are thereby fixed to the other end portion of the fitting projection 75. The operation of mounting one set of disk hoisting tool 71 to the turbine disk 5 is completed.

When the turbine disk 5 is hoisted at three or four points, three or four sets of disk hoisting tools 71 are mounted to predetermined positions of the turbine disk 5 by the same procedure.

A procedure to remove the disk hoisting tool 71 according to the present embodiment from the turbine disk 5 is simply opposite to the above procedure. Thus, the description thereof is omitted here.

In accordance with the disk hoisting tool 71 according to the present embodiment, only the fitting projection 75 formed so as to be fitted with the blade groove 6 of the turbine disk 5 is inserted into the blade groove 6. The wire 92 is not fitted into the blade groove 6 of the turbine disk 5 unlike in conventional cases.

Accordingly, deformation or fracture of a corner portion of the blade groove 6, and damage to a surface forming the blade groove 6 can be prevented.

Since the deformation or fracture of the corner portion of the blade groove 6 due to the wire 92 is prevented, falling of the turbine disk 5 can be also prevented. The safety of personnel can be thereby improved.

Moreover, the turbine disk 5 can be safely reversed.

In accordance with the disk hoisting tool 71 according to the present embodiment, the hoisting body 72 is fixed to the turbine disk 5 via a fixing means including the two stoppers (a first stopper and a second stopper) 73, and the two hexagon socket head bolts (a first bolt and a second bolt) 13. Thus, even when the blade groove 6 is formed parallel to an axial direction (plate thickness direction) of the turbine disk 5, the turbine disk 5 can be more safely hoisted. The safety of personnel can be further improved.

Furthermore, in accordance with the disk hoisting tool 71 according to the present embodiment, as compared to a case in which the axial line of the bolt hole 76 is formed along a height direction (direction perpendicular to a longitudinal direction) of the fitting projection 75, decreases in sectional area and strength in the height direction (vertical direction) due to the bolt hole 76 of the fitting projection 75 can be reduced.

It should be noted that the present invention is not limited to the aforementioned embodiments, and may be changed and modified as appropriate according to need.

In addition to the compressor disk 2 that constitutes the compressor (axial flow compressor) of the gas turbine and the turbine disk 5 that constitutes the turbine (axial flow turbine) of the gas turbine, the present invention may be also applied to a disk belonging to any technical field as long as a plurality of blade grooves (fitting grooves) penetrating in a plate thickness direction are circumferentially formed (machined) in a peripheral portion of the disk.

REFERENCE SIGNS LIST

1 Disk hoisting tool
2 Compressor disk
3 Blade groove (fitting groove)
5 Turbine disk
6 Blade groove (fitting groove)
11 Hoisting body
12 Stopper (fixing means)
13 Hexagon socket head bolt (fixing means)
21 Eye plate
22 Fitting projection
31 Eye (through hole)
32 Bolt hole
42 Bolt hole
45 Disk hoisting tool
51 Hoisting body
52 Fitting projection
53 Bolt hole
61 Stopper (fixing means)
63 Bolt hole
71 Disk hoisting tool
72 Hoisting body
73 Stopper (fixing means)
74 Eye plate
75 Fitting projection
76 Bolt hole
82 Bolt hole.

The invention claimed is:

1. A disk hoisting tool which is mounted so as to hoist a compressor disk and/or a turbine disk for mounting blades where a plurality of fitting grooves for engaging blades that penetrate in a plate thickness direction are circumferentially formed in a peripheral portion, said disk hoisting tool comprising:

a hoisting body comprising:

an eye plate comprising a through hole penetrating in a plate thickness direction;

a fitting projection formed so as to be fitted with the fitting groove; and a fixing means that fixes the hoisting body to the disk, wherein the fixing means comprises:

a first stopper arranged at one end portion of the fitting projection located on one end surface side of the disk to restrain movement of the hoisting body to the other end surface side of the disk;

a first fixing portion inserted into a hole formed in the one end portion of the fitting projection and a hole formed in the first stopper to fix the first stopper to the one end portion of the fitting projection;

a second stopper arranged at the other end portion of the fitting projection located on the other end surface side of the disk to restrain movement of the hoisting body to the one end surface side of the disk; and a second fixing portion inserted into a hole formed in the other end portion of the fitting projection and a hole formed in the second stopper to fix the second stopper to the other end portion of the fitting projection, wherein the fitting projection is a member that has a same shape as a blade root of the blade to be embedded in the fitting groove.

2. The disk hoisting tool according to claim 1, wherein each of the hole formed in the one end portion of the fitting projection and hole formed in the other end portion of the fitting projection is formed such that its axial line is aligned with a longitudinal direction of the fitting projection.

* * * * *